United States Patent [19]

Clark et al.

[11] Patent Number: 4,664,562

[45] Date of Patent: May 12, 1987

[54] CRIBWALLING

[76] Inventors: Erin C. Clark, 7 Samoa Street, Kilbirnie, New Zealand; Graham F. Pyne, 20 Chapman Street, Johnsonville, New Zealand

[21] Appl. No.: 639,484

[22] Filed: Aug. 10, 1984

Related U.S. Application Data

[63] Continuation-in-part of Ser. No. 313,165, Oct. 20, 1981, abandoned.

[30] Foreign Application Priority Data

Oct. 30, 1980 [NZ] New Zealand ..... 195408
Sep. 28, 1983 [NZ] New Zealand ..... 205792

[51] Int. Cl.[4] ..... E02D 17/00

[52] U.S. Cl. ..... 405/273; 405/284

[58] Field of Search ..... 405/284–286, 405/273

[56] References Cited

U.S. PATENT DOCUMENTS

| | | | |
|---|---|---|---|
| 1,215,537 | 2/1917 | Hyatt | 405/273 |
| 1,262,224 | 4/1918 | Melvin | 405/273 |
| 1,485,381 | 3/1924 | Evers | 405/273 X |
| 1,500,119 | 7/1924 | Evers | 405/273 |
| 1,596,759 | 8/1926 | Nagel | 405/273 |
| 1,666,250 | 4/1928 | Alexander | 405/273 |
| 1,703,303 | 2/1929 | Fitzgerald | 405/273 |
| 1,773,579 | 8/1930 | Flath | 405/273 |
| 1,787,199 | 12/1930 | Huntoon | 405/273 |
| 1,953,005 | 3/1934 | Nagel | 405/273 |
| 2,034,851 | 3/1936 | Wichmann | 405/273 |
| 2,094,167 | 9/1937 | Evers | 405/273 |
| 2,315,441 | 3/1943 | McDaniel | 405/273 |
| 2,365,397 | 12/1944 | Dickman | 52/233 X |
| 2,820,349 | 1/1958 | Cooper | 405/273 |
| 2,828,613 | 4/1958 | Wilson | 405/273 |
| 4,512,685 | 4/1985 | Hegle | 405/284 |

FOREIGN PATENT DOCUMENTS

| | | |
|---|---|---|
| 22329 | 8/1948 | Australia . |
| 34889 | 5/1973 | Australia . |
| 52605 | 8/1984 | Australia . |
| 0016353 | 2/1980 | European Pat. Off. . |
| 031154 | 7/1981 | European Pat. Off. . |
| 2817549 | 10/1979 | Fed. Rep. of Germany . |
| 3034131 | 4/1982 | Fed. Rep. of Germany . |
| 2421243 | 10/1979 | France . |
| 81141 | 4/1979 | Luxembourg . |
| 138830 | 7/1964 | New Zealand . |
| 191143 | 7/1964 | New Zealand . |
| 749003 | 5/1956 | United Kingdom . |
| 1486195 | 9/1977 | United Kingdom . |
| 1586427 | 3/1981 | United Kingdom . |

OTHER PUBLICATIONS

European Search Report EP 84 30 6105, May 30, 1985, the Hague, Netherlands (with Annex).

*Primary Examiner*—James A. Leppink
*Assistant Examiner*—Matthew Smith
*Attorney, Agent, or Firm*—Holman & Stern

[57] ABSTRACT

A cribwall comprising (A) a skeletal wall structure made up of components such that there is (i) a plurality of tiers of headers each substantially normal to the general plane of the wall, each header having front and rear end rebates top and bottom, and with each header of one tier being above and/or below a header of an adjacent header, (ii) wall wise extending stretchers each of which spans at least two headers of a tier and the corresponding at least two headers of an adjacent tier and is located between the tiers by the said front end top and bottom rebates of the proximate headers, (iii) rear end header spacing means selected from wallwise extending stretchers or keyblocks which are interposed between each pair of adjacent tiered headers and are located by said rear top and bottom rebates thereof, and (iv) header support blocks interposed between at least some of the tiered headers between a stretcher and the rear end header spacing means so as to enhance the load carrying capability of the resultant structure, and (B) fill material at least substantially filling said skeletal wall structure. The formed in wood of substantially rectangular cross-section and having top and bottom (i) a lengthwise extending groove and (ii) rebates adjacent each end that extend fully across the transverse section.

8 Claims, 12 Drawing Figures

CRIBWALLING

This application is a continuation-in-part of co-pending U.S. patent application Ser. No. 06/313,165, now abandoned filed Oct. 20, 1981.

The invention of this application is described in corresponding European Patent Application EP 84 30 6105.

BACKGROUND OF THE INVENTION

1. Field of the Invention

The present invention relates to improvements in cribwalling where to enhance crush resistance a header support block or a plurality thereof are used between normal and/or corner headers.

2. Description of the Prior Art

Many forms of cribwalling are known. Some forms utilize concrete components while others use preserved timber components. With cribwalls formed from timber components, a number of different components are utilized in order to achieve a stable structure. Components include sleepers, stretchers, headers and keyblocks. Headers normally include two pairs of rebates to receive on their leading end below and above the header the associated two stretchers and on the back end to receive stretchers and/or keyblocks in a similar fashion. A difficulty arises however, where a cribwall is to extend upwards to a great height. The difficulties arise through the fact that over a certain height there is the prospect of the timber at the lower reaches of the cribwall being crushed under the weight of the structure i.e. not only the timber assembly itself but also the fill. There is some need to ensure that timber cribwalls are not severely restricted as to their height capability.

It is therefore an object of the present invention to provide means and/or methods which will overcome the above problems.

BRIEF SUMMARY OF THE INVENTION

In one aspect the present invention consists in a cribwall comprising (A) a skeletal wall structure made up of components such that there is (i) a plurality of tiers of headers each substantially normal to the general plane of the wall, each header having front and rear end rebates top and bottom, and with each header of one tier being above and/or below a header of an adjacent header, (ii) wall wise extending stretchers each of which spans at least two headers of a tier and the corresponding at least two headers of an adjacent tier and is located between the tiers by the said front end top and bottom rebates of the proximate headers, (iii) rear end header spacing means selected from wallwise extending stretchers or keyblocks which are interposed between each pair of adjacent tiered headers and are located by said rear top and bottom rebates thereof, and (iv) header support blocks interposed between at least some of the tiered headers between a stretcher and the rear end header spacing means so as to enhance the load carrying capability of the resultant structure, and (B) fill material at least substantially filling said skeletal wall structure Preferably each kneader support block is a substantially retanguloid block having a pair of opposed rectangular or square rebates each located to straddle a header.

Preferably each header to be associated with a header support block includes on its top and bottom at least one groove or channel extending therealong at least over the regions thereof where a header support block is to be located and such at least one groove or channel is engaged by a projecting region or regions of the header support block so as to be located thereby between the pair of tiered headers.

Preferably all of the components of the skeletal wall structure are formed in wood.

Preferably all headers and header support blocks are formed in wood and the headers have a longitudinally extending groove top and bottom from one end to the other broken only by said rebates.

Preferably stretchers are provided to separate the tiered pairs of headers both front and rear.

In a further aspect the present invention consists in a header for a cribwall including header support blocks, said header formed in wood of substantially rectangular cross-section and having top and bottom (i) a lengthwise extending groove and (ii) rebates adjacent each end that extend fully across the transverse section.

Preferably the timber dimensions used for the various components whether header support blocks, keyblocks, stretcher, sleepers, or headers are of a cross section of approximately 100/50 mm (96×42 if finished) with the machined rebates being made in the 50 mm wide faces.

Preferably a standard header is 450, 600, 900 or 1200 mm long.

Preferably a standard corner header is 450 mm long but with the length of the machining of the rebate for straddling the butted stretchers being substantially twice the extent of the machining on a normal header.

BRIEF DESCRIPTION OF THE DRAWINGS

Preferred forms of the present invention will now be described with reference to the accompanying drawings.

DETAILED DESCRIPTION

Figure 6:
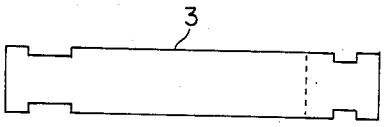
FIG. 6 is a view in elevation of a length of timber which has double sized or substantially double sized opposed rectangular rebates at one end suitable as rebates for a corner header while at the other end it has the opposed rebates suitable for a header support block in accordance with the present invention, the dotted line showing how a length of timber capable of being rebated at both ends at once can have the necessary rebates prepared and subsequently the length of timber can be cut, for example by a saw, along the dotted line to provide a corner header of the requisite length and a header support block.
Figure 7:
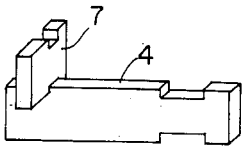
FIG. 7 shows in perspective a corner header having associated therewith a header support block.
Figure 8:
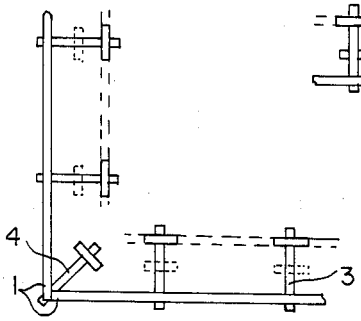
FIG. 8 is a top plan view of an external corner showing the corner header located below stretchers and having placed thereon a header support block while the other headers shown have at the inner region thereof keyblocks appropriately located or as denoted by the dotted lines stretchers; the figure also showing in dotted lines how, if desired, for the particular level header support blocks can be interposed between the front stretcher or stretchers and the back positioned stretcher keyblock as the case may be.
Figure 9:
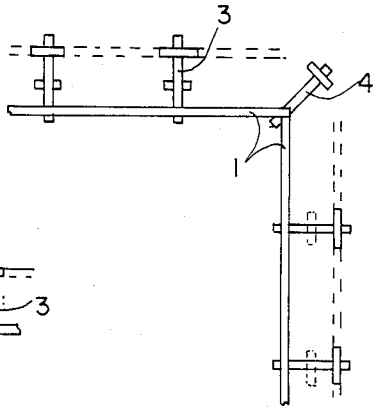
FIG. 9 is a similar view to that of FIG. 8 but this time for an internal corner.
Figure 10:
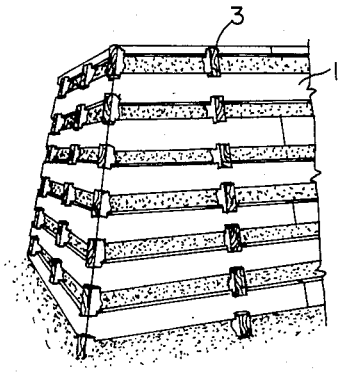
FIG. 10 is a perspective view of a corner of a cribwall in accordance with the present invention after the same has been back filled.

In one preferred form of the present invention the header support blocks are formed firstly by forming a standard header and thereafter making two simple transverse cuts to define two header support members and a keyblock. By following this procedure great economies are achieved. For example no resetting of the milling, router or the like machine which machines the rebates of a standard header is necessary. Moreover it is difficult to machine a small length of timber such as a keyblock directly. Another way of forming the header support block is as depicted in FIG. 6. Here instead of forming a normal header and cutting therefrom two header support blocks and a keyblock, a single cut results in a head support member and a corner header. For the purpose of understanding the appended drawings the following reference will be adopted:

(1) Stretchers irrespectively of their length will be designated where deemed necessary by the reference numeral 1,
(2) Sleepers will be designated by reference numeral 2,
(3) Normal headers will be designated by reference numeral 3,
(4) Corner headers will be referenced by reference numeral 4,
(5) Rearward stretchers will be designated by reference numeral 5,
(6) Keyblocks will be designated by reference numeral 6, and
(7) Header support blocks irrespective of whether for a corner or a normal header by reference numeral 7.

Obviously the loading of a crib wall structure is such that the lower reaches must bear a greater loading than the upper reaches. In this respect it is often stated in the crib wall art that a wall must be designed downwardly. In this respect reference should be made to Table 1 which for a specific series, i.e. type of wall indicates the maximum height of wall deemed desirable.

TABLE 1

MAXIMUM ALLOWABLE HEIGHT FOR FACING WALLS

| Series (header length mm) | H (meters) |
|---|---|
| 450 | 2.0 |
| 600 | 4.0 |
| 900 | 5.5 |
| 1200 | 5.5 |

It is to be noted that the series is a millimeter length value of the headers, i.e. normal headers employed. Having chosen the depth of wall (with reference to the series type) the header spacing at different levels within the structure must be considered. Obviously at greater depths the header support blocks utilized between headers must also be considered.

TABLE 2

HEADER SPACING

| Series | Wall Height Measured from from Top of Bank (m) | Header Support Blocks # | Header Spacing (mm) |
|---|---|---|---|
| 450L | Up to 1.2 | — | 600 |
| 600L | Up to 2.0 | — | 600 |
| 450 | Up to 2.0 | — | 600 |
| 600 | Up to 2.5 | — | 600 |
| | 2.5 to 4.0 | 1 | 600 |
| 900 | Up to 2.0 | — | 600 |
| | 2.0 to 3.0 | 1 | 600 |
| | 3.0 to 4.0 | 1 every alternate header | 300 |
| | 4.0 to 5.5 | 1 | 300 |
| 1200 | Up to 2.0 | — | 600 |
| | 2.0 to 3.0 | — | 300 |
| | 3.0 to 4.0 | 1 | 300 |
| | 4.0 to 5.5 | 2 | 300 |

For the purpose of understanding Table 2 it should be borne in mind that the preferred rectangular cross-section from which the various components have been formed is 100 mm by 50 mm within the machined rebates, or grooves, made in the 50 mm wide faces. It should also be realised that the bulk of the stretchers utilized will be in the preferred form of the present invention 1.2 meters long while at the corners or at the end of the crib wall either 0.9 or 1.5 meters long stretchers can be used to provide the requisite finish. In this respect it is to be noted that a 600 mm module would be provided.

Figure 1:
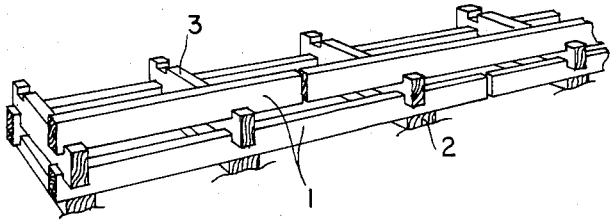
FIG. 1 is perspective view of the lower reaches of a conventional timber cribwall showing at the lowest most level a plurality of sleepers over which have been run stretchers engaging a series of normal headers which in turn receive an upper level of stretchers at the front (i.e. the near) side thereof.
Figure 2:
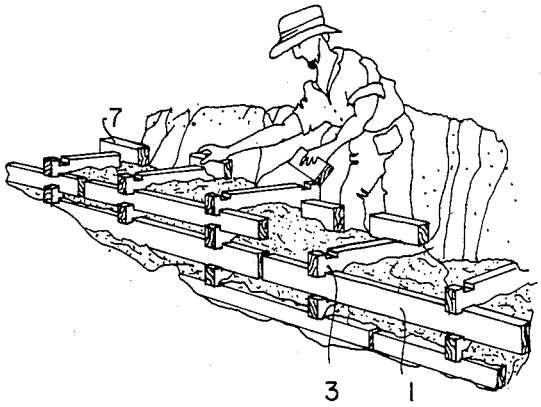
FIG. 2 shows an arrangement as shown in FIG. 1 at a subsequent stage where some fill has been placed in the structure to stabilize the same and progressive levels are made up using the same headers but, while conventional stretchers are used along the front, much shorter members (i.e. keys) are used at the back to provide the requisite spacing between adjacent levels of header.
Figure 3:
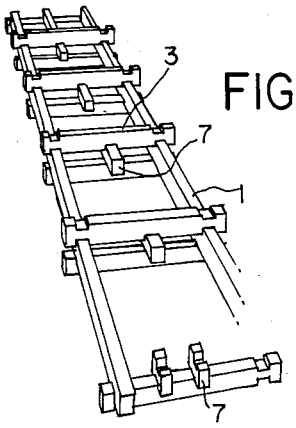
FIG. 3 is a perspective view which shows how, if desired, the crush resistance of the overall structure can be increased by interposing a header support block or other member between adjacent levels of header midway along the length thereof, it being seen that a header support block in accordance with the present invention, if provided with the necessary machining, can straddle in a stable manner each associated header so as to stably support the same and consequently can be positioned at any position between the stretcher and/or keyblocks (not shown for the lower levels shown in FIG. 3) or can be positioned to provide a plurality of supports intermediate the length of a header.
Figure 4:
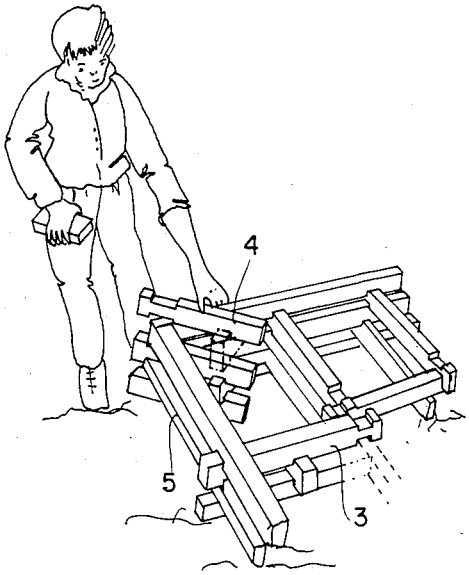
FIG. 4 is a perspective view which shows a corner formed with a structure of the kind as shown in FIG. 3 but where the stretchers substantially butt, and consequently for aesthetics and also for support, a corner header member which need not have machining at its inner end can be positioned to provide the requisite spacing and support, preferably such corner headers having twice the longitudinal extent of the machining of the normal headers so as to accommodate the diagonal aspect of the stretchers, it being seen how a header support block in accordance with the present invention can be interposed between adjacent corner headers and act as a header spacing member in lieu of a stretcher or keyblocks.
Figure 5:
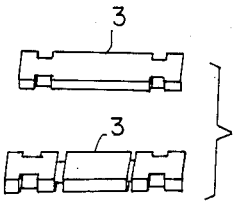
FIG. 5 shows in perspective firstly a standard header block and secondly how by making two cuts therethrough two further support blocks in accordance with the present invention can be prepared together with a substantially standard keyblock.

Table 2 refers to different series of wall. As depicted in FIG. 4 the wall in question is a 900 series wall of 3.5 meters at its greatest depth. It can be seen therefore from Table 2 that for the first two meters down that headers need be provided only at 600 mm spacings, thus for each 1.2 meter long stretcher there would be two headers as depicted—it being realized that for the top identical rows, indicated by reference numeral 3, additional machining of the various headers has not been carried out. It can be seen from Table 2 that for the depth of two meters to three meters the 600 mm spacing of the headers is maintained although header support blocks must be provided. For depths below 3 meters the spacing of the header is 300 mm as opposed to 600 mm. At this level a header support block is provided for every alternate header.

It can be seen therefore that the present invention constitutes a simple means whereby at least lower reaches of a straight or cornered cribwall can be supported to minimize the risk of crush, it being let to the at least as many header support blocks as the design specification specifies, there being great scope of course for enhanced resistance as more than one header support block can be interposed between any adjacent levels of header whether they be standard headers or corner headers.

Such double rebated, or grooved, header support blocks are still relatively difficult to manufacture. They also provide with a particular volume of timber only a certain amount of support between vertically adjacent headers. Moreover their straddling arrangement makes it possible for them to become displaced during the filling operation where backfill or other fill is dropped into an at least partially erected cribwall structure.

Figure 11:
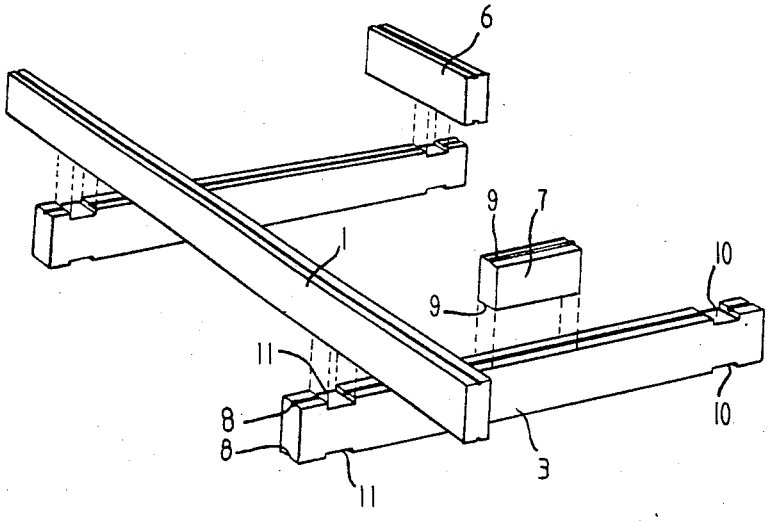
FIG. 11 is an exploded perspective view showing the most preferred form of the components in accordance with the present invention and the manner in which the preferred headers and header support blocks can be located and used in conjunction with other components such as stretchers and keyblocks.
Figure 12:
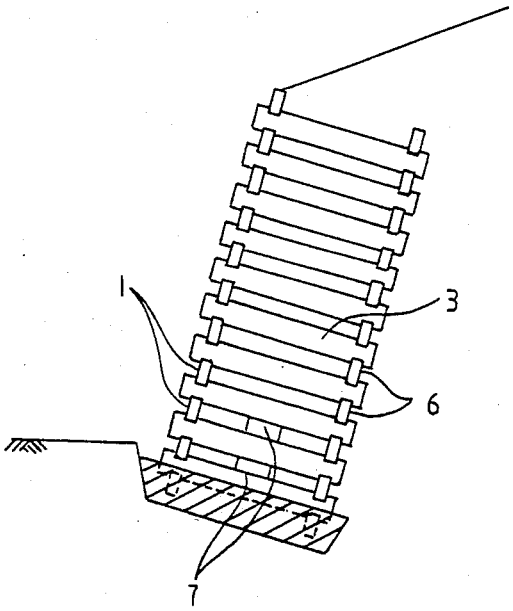
FIG. 12 is an end view of one form of cribwall formed using components in accordance with FIG. 11.

With the use of the components of FIGS. 11 and 12 it is possible per given volume of component material to achieve greater cribwall heights. In the preferred form of the present invention the header support blocks 7 are substantially rectanguloid but include longitudinally extending therealong an easily machineable locating ridge, tongue or other profile 9. Indeed if desired there can be a plurality of locating means which axially extend. Ideally the locating means extend axially so that mass production is facilitated. With a timber form (which is the preferred form) the grain of all the components extends longitudinally of the component.

The preferred header 3 is preferably a conventional header having two pairs of rebates, or transverse notches 10 and 11, the rebates 10 and 11 being adapted to receive a keyblock 6 and a stretcher 1 respectively. The header 3 includes, top and bottom, a header support block locating means 8 which is preferably a groove (preferably a square channel) extending the full length of the header but having less depth than the transverse notches 10 and 11 into which the rib means 9 can engage to locate the header support blocks 7 so as to align longitudinally with vertically adjacent headers 3. Obviously in other forms of the present invention different complementary locating means can be provided between headers and header support blocks and indeed if desired such means need not be symmetrical. The preferred form however is desirable as it lends itself to easy mass production. For example, the grooves 8 are shown as being common to the stretcher and the keyblock since it is possible with the present invention to machine all such components using the same shaping machinery. Only the header support block need be manufactured with the machines set differently.

Ideally the header support block is configured so a to be under a degree of compression when the structure is being erected so as to ensure axial location. Such axial location will be further enhanced by the compression of the material once the fill is included in the cribwall framing structure.

On the basis of the foregoing therefore it can be seen that strong timber based cribwalls can be prepared which extend to a much greater height than previously thought possible.

We claim:

1. A header for a cribwall, including header support blocks, said header being elongated and formed of wood of substantially constant rectangular cross-section with top and bottom faces narrower than side faces, and having in said top and bottom faces a lengthwise extending longitudinal groove extending the full length of the header and transverse notches adjacent each end of the header that extend transversely fully across said top and bottom faces and interrupt said longitudinal grooves, said notches having a greater depth than said grooves.

2. A cribwall comprising:

a skeletal wall structure having front and rear sides and made up of wooden components such that there is a plurality of tiers of headers each extending substantially normal to the general plane of the wall, with each header of one tier, except the lowermost and uppermost headers, being above and below a header of an adjacent tier;

each header having a substantially constant rectangular cross-section and top and bottom surfaces narrower than the side surfaces thereof;

a lengthwise extending longitudinal groove in said top and bottom surfaces extending the full length of said header;

a transverse notch adjacent each end and extending fully across each narrower top and bottom surface substantially perpendicular to and interrupting said longitudinal grooves, said notches having a greater depth than said longitudinal grooves;

wall-forming stretchers having a rectangular cross-section each of which spans at least two headers of a tier and the corresponding at least two headers of an adjacent tier and is located between the tiers and received within top and bottom transverse notches in the proximate headers adjacent said front side;

rear end header spacing members, each having a rectangular cross-section and narrower top and bottom sides, interposed between each pair of adjacent tiered headers and located and received within top and bottom transverse notches in the proximate headers adjacent said rear side, said spacing members having a longitudinal axis extending substantially parallel to said stretchers;

header support blocks interposed between at least some of the corresponding adjacent headers of adjacent tiers between said transverse notches to enhance the load-carrying capability of the resultant structure, each header support block having a rectangular cross-section with narrower top and bottom faces and protruding ribs longitudinally extending along said top and bottom faces for engaging in said longitudinal grooves in a corespondning adjacent pair of headers; and fill material at least substantially filling the skeletal wall structure.

3. A cribwall as claimed in claim 2 wherein said rear end header spacing members comprise a plurality of stretchers each of which spans at least two headers of an adjacent tier.

4. A cribwall as claimed in claim 2 wherein said rear end header spacing member comprise a plurality of keyblocks each of which is interposed between only a single pair of adjacent tiered headers.

5. A cribwall as claimed im claim 2 wherein:

said longitudinal grooves each have a width less than one-half the width of said top and bottom faces; and said protruding ribs on said header support blocks substantially conform to said longitudinal grooves.

6. A cribwall as claimed in claim 3 wherein: p1 said longitudinal grooves each have a width less than one-half the width of said top and bottom faces; and said protruding ribs on said header support blocks substantially conform to said longitudinal grooves.

7. A cribwall as claimed in claim 4 wherein:

said longitudinal grooves each have a width less than one-half the width of said top and bottom faces; and said protruding ribs on said header support blocks substantially conform to said longitudinal grooves.

8. A cribwall as claimed in claim 1 wherein:

said longitudinal grooves each have a width less than one-half the width of said top and bottom faces.

* * * * *